US007340986B1

(12) United States Patent
Gaigler

(10) Patent No.: US 7,340,986 B1
(45) Date of Patent: Mar. 11, 2008

(54) APPARATUS COMPRISING A RELEASE SYSTEM FOR CANISTERED MUNITIONS

(75) Inventor: Randy L. Gaigler, Parkville, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 178 days.

(21) Appl. No.: 11/091,233

(22) Filed: Mar. 28, 2005

(51) Int. Cl.
*F41F 3/052* (2006.01)

(52) U.S. Cl. ..... 89/1.806; 89/1.812; 89/1.818

(58) Field of Classification Search ..... 89/1.802, 89/1.806, 1.807, 1.818, 1.812
See application file for complete search history.

(56) References Cited

U.S. PATENT DOCUMENTS 3,499,364 A * 3/1970 D'Ooge ..... 89/1.81
4,304,170 A * 12/1981 King ..... 89/1.807
4,550,640 A 11/1985 Harter
4,616,554 A * 10/1986 Spink et al. ..... 89/1.806
5,398,588 A * 3/1995 Peck ..... 89/1.806
6,286,409 B1 * 9/2001 Na et al. ..... 89/1.806

* cited by examiner

*Primary Examiner*—Stephen M Johnson
(74) *Attorney, Agent, or Firm*—DeMont & Breyer LLC

(57) ABSTRACT

The illustrative embodiment of the present invention is a munitions launch system. The launch system comprises a canister and a cold launch system. In the illustrative embodiment, the cold launch system comprises a sled and a release system. In the illustrative embodiment, the release system includes a sled release mechanism, which releasably secures the sled to the munitions canister, and a munitions release mechanism, which releasably secures a munition to the sled. Actuation of the sled release mechanism releases the sled for movement within the canister. After the sled moves some minimal distance under applied force, the munitions release mechanism "automatically" actuates, releasing the munition from the sled so that the munition can be ejected from the canister.

17 Claims, 3 Drawing Sheets

APPARATUS COMPRISING A RELEASE SYSTEM FOR CANISTERED MUNITIONS

FIELD OF THE INVENTION

The present invention relates to canistered munitions, and more particularly to launch mechanisms for canistered munitions.

BACKGROUND OF THE INVENTION

It is well known in the art to launch a missile from a canister. Missiles are launched from canisters using either a "hot" launch technique or a "cold" launch technique.

During hot launch, the missile's motor ignites while the missile is in the canister. The motor provides the thrust that is required to propel the missile from the canister. During cold launch, an ancillary system is used eject the missile from the canister; that is, the missile's motor does not ignite until after the missile leaves the canister. In some cold launch systems, the ancillary system comprises a sled or base upon which the missile rests. During launch, the sled and the missile are accelerated toward the front end of the canister. The sled is abruptly stopped at the forward end of the canister while the missile exits the canister due to its inertia.

A restraint/release mechanism (hereinafter simply "release" mechanism) normally secures the missile within the canister prior to launch to prevent damage to the missile and to maintain its orientation within the canister. Of course, this mechanism must release the missile for launch.

Hot launch systems employ either an active release mechanism, such as explosive bolts, or a passive release mechanism, such as a combination of springs and latches. When a passive mechanism is used, missile motor ignition is often used to trigger the passive mechanism into release. See, for example, U.S. Pat. No. 4,550,640. Of course, that technique is only suitable for hot launch, since the missile does not ignite within the canister during cold launch. Cold launch systems, especially those that include a sled or base to accelerate the missile, often use two release mechanisms, which are typically active mechanisms. The first mechanism releasably couples the sled or base to the canister and the second mechanism releasably couples the missile to the sled.

There is a risk that the release mechanism will not release during launch. This results in a restrained firing, which can cause damage to the canister, canister internals, and the missile itself. This risk is typically greater for a cold launch system than a hot launch system, and the risk is especially elevated for a cold launch system that uses two release mechanisms.

There is a need, therefore, for a release mechanism that substantially prevents the possibility of a restrained firing during launch of a canistered munition.

SUMMARY OF THE INVENTION

The present invention provides a release system for canistered missiles, especially for cold-launched canistered missiles, which avoids some of the costs and disadvantages of the prior art.

In the illustrative embodiment, a munitions launch system comprises a canister and a cold launch system. The cold launch system comprises a sled and a release system.

The sled is initially restrained within the canister near the aft end, but is released during launch. During launch, the sled moves toward the forward end of the canister under an applied force, pushing a munition, such as a missile, along with it. When the sled is abruptly stopped at the forward end of the canister, the missile is ejected from the canister by virtue of its own inertia.

In the illustrative embodiment, the release system includes two release mechanisms:

- a sled release mechanism, which releasably secures the sled to the munitions canister; and
- a munitions release mechanism, which releasably secures the munition to the sled.

In the illustrative embodiment, the sled release mechanism is an active release mechanism and the munitions release mechanism is a passive release mechanism.

As used in this specification, the phrase "active release mechanism" refers to a release mechanism that actuates under its own power. An example of an active release mechanism is an explosive bolt. The bolt includes an explosive charge that, when ignited, frees whatever structure is being restrained by the bolt.

As used in this specification, the phrase "passive release mechanism" refers to a release mechanism that is triggered by an ancillary event or mechanism that is not, per se, a part of the passive release mechanism. An example of such an ancillary event is a change in state (e.g., position, velocity, orientation, etc.) of a member (ancillary member) that is operatively coupled to or otherwise affects a passive release mechanism, but that is not a part of that passive release mechanism.

The release system used in conjunction with the illustrative embodiment of the invention operates as follows. The sled release mechanism, which in the illustrative embodiment is a plurality of explosive bolts, is actuated first. This releases the sled for movement within the canister. After the sled moves some minimal distance under applied force (e.g., pressure, pneumatics, hydraulics, electromagnetics etc.), the munitions release mechanism "automatically" actuates. This releases the munition from the sled so that the munition can be ejected from the canister.

In the illustrative embodiment, the munitions release mechanism comprises a pivotable latch, a movable trigger pin, and an immovable support pin.

The latch is disposed on the upper surface of the sled and is positioned so that it can releasably engage notches that are formed in the casing of the munition. The latch pivots between an "anchoring" position and a "release" position. In the anchoring position, the latch engages a notch, thereby securing the munition to the sled. In the release position, the latch disengages from the notch, releasing the munition from the sled. As described below, the position of the latch is dictated, ultimately, by movement/position of the sled.

The trigger pin is disposed partially within a hole that passes through the sled. The trigger pin slides freely up or down through this hole, moving between a "supporting" position and a "triggering" position as a function of the position of the sled.

In the supporting position, the trigger pin is extended to a maximum distance beyond the upper surface of the sled. The trigger pin is urged forward into the supporting position when the sled is at its most aft location in the canister (i.e., before the sled is released). In this position, the trigger pin is supported by the underlying immovable support pin, which is permanently secured near the aft end of the canister. The support pin forces the trigger pin into contact with the latch and prevents the latch from pivoting away from its anchoring position.

As the sled moves toward the forward end of the canister, the trigger pin loses the support of the underlying immovable support pin. Unsupported, the trigger pin falls out of contact with the latch and into the triggering position, dropping some distance within the hole in the sled. The latch is then free to pivot to the release position, which it does, urged by gravity, a spring bias, etc. This releases the munition from the sled.

The arrangement of:

a sled release mechanism (either actively or passively actuated) for releasing the sled from the canister;

and a munition release mechanism (passively actuated) for releasing the munition from the sled, wherein the munition release mechanism actuates as a function of movement/position of the sled ensures that if the sled releases from the canister, the munition will decouple from the sled. This substantially eliminates the possibility of a restained launch, which might occur in a system in which the munition must actively release from the sled.

BRIEF DESCRIPTION OF THE DRAWINGS

FIG. 1 depicts the launch system in a pre-launch state.

FIG. 3 depicts the mechanisms in a pre-launch state.

DETAILED DESCRIPTION

Figure 1:
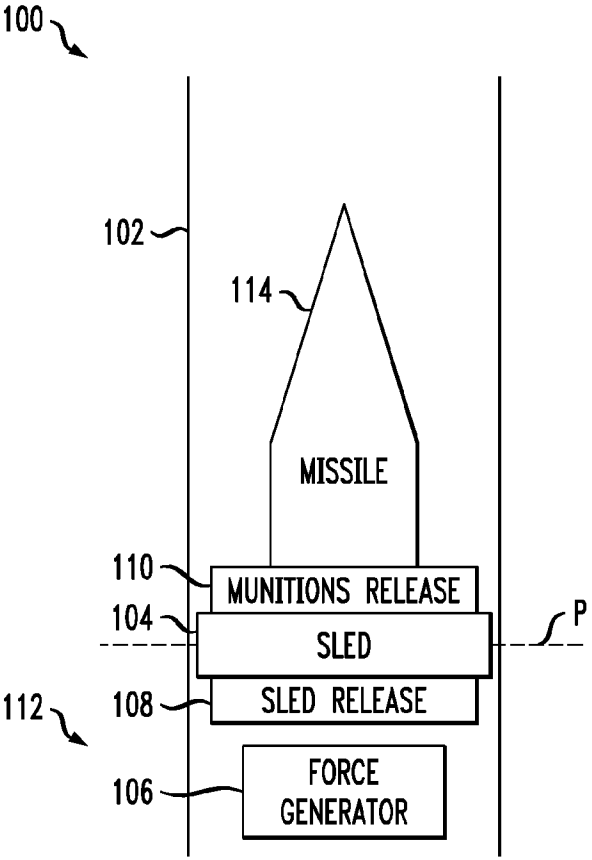
FIG. 1 depicts a launch system in accordance with the illustrative embodiment of the present invention.

FIG. 1 depicts a simplified partial view of launch system 100 in accordance with the illustrative embodiment of the present invention. Launch system 100 includes canister 102, sled 104, force generator 106, sled release mechanism 108, and munitions release mechanism 110. FIG. 1 depicts launch system 100 in a pre-launch state.

It will be understood that launch system 100 typically includes other internal parts and mechanisms. These other internals are not depicted since they are well known to those skilled in the art and not germane to an understanding of the present invention.

As depicted in FIG. 1, sled 104 is disposed near aft end 112 of canister 102 in pre-launch position P. Sled release mechanism 108 and munitions release mechanism 110 are operatively coupled to sled 104. In particular, sled release mechanism 108 releasably couples sled 104 to aft end 112 of canister 102. And munitions release mechanism 110 releasably couples munition 114 to sled 104.

Sled release mechanism 108 and munitions release mechanism 110 prevent sled 104 and munition 114 from moving prior to launch. After release, such as is depicted in FIG. 2, sled 104 is free to move toward forward end 216 of canister 102 and munition 114 is free to exit the canister.

Figure 2:
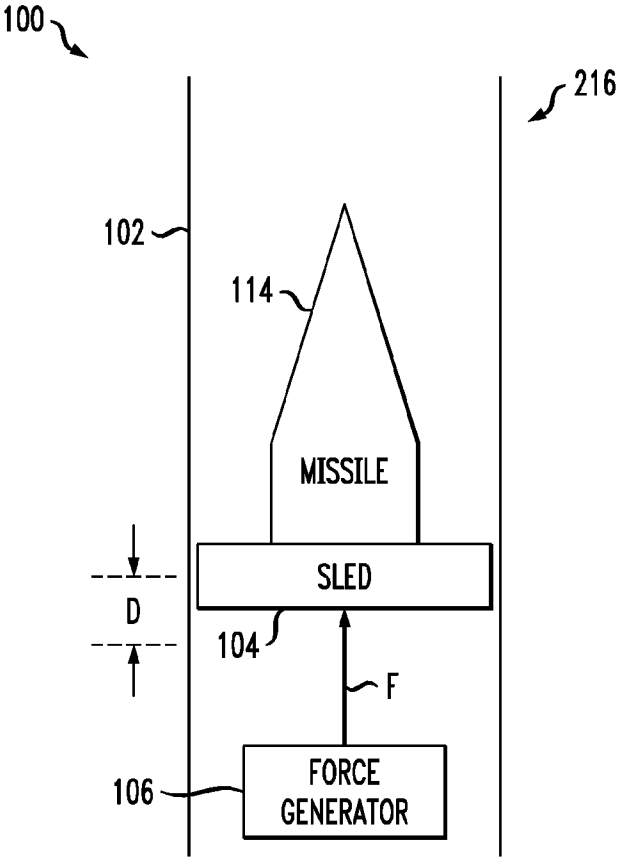
FIG. 2 depicts the launch system of FIG. 1 during launch, after the sled has moved a distance D.

FIG. 2 depicts system 100 during launch, after sled 104 has moved a distance D. Sled release mechanism 108 is actuated to release sled 104 from canister 102. (Actuation of sled release mechanism 108 and release of sled 104 is signified by the absence of the sled release mechanism in FIG. 2.) Force generator 106 provides force F that urges sled 104 into motion.

In some embodiments, force generator 106 is a gas generator. The gas generated by the gas generator rapidly fills and pressurizes the region aft of sled 104. The pressure accelerates the sled and munition 114 toward forward end 216 of canister 102. See, e.g., U.S. patent application Ser. No. 11/091,221, filed Mar. 28, 2005 and incorporated herein by reference. In some other embodiments, the motive force can be, without limitation, hydraulic, pneumatic, and electromagnetic, as supplied by appropriate mechanisms.

By the time sled 104 has moved distance D from its pre-launch position, P, munitions release mechanism 110 is actuated, thereby releasing munition 114 from the sled. (This is signified by the absence of the munitions release mechanism in FIG. 2.) Munitions release mechanism 110 is physically configured so that release occurs passively based on the movement or position of sled 104.

Figure 3:
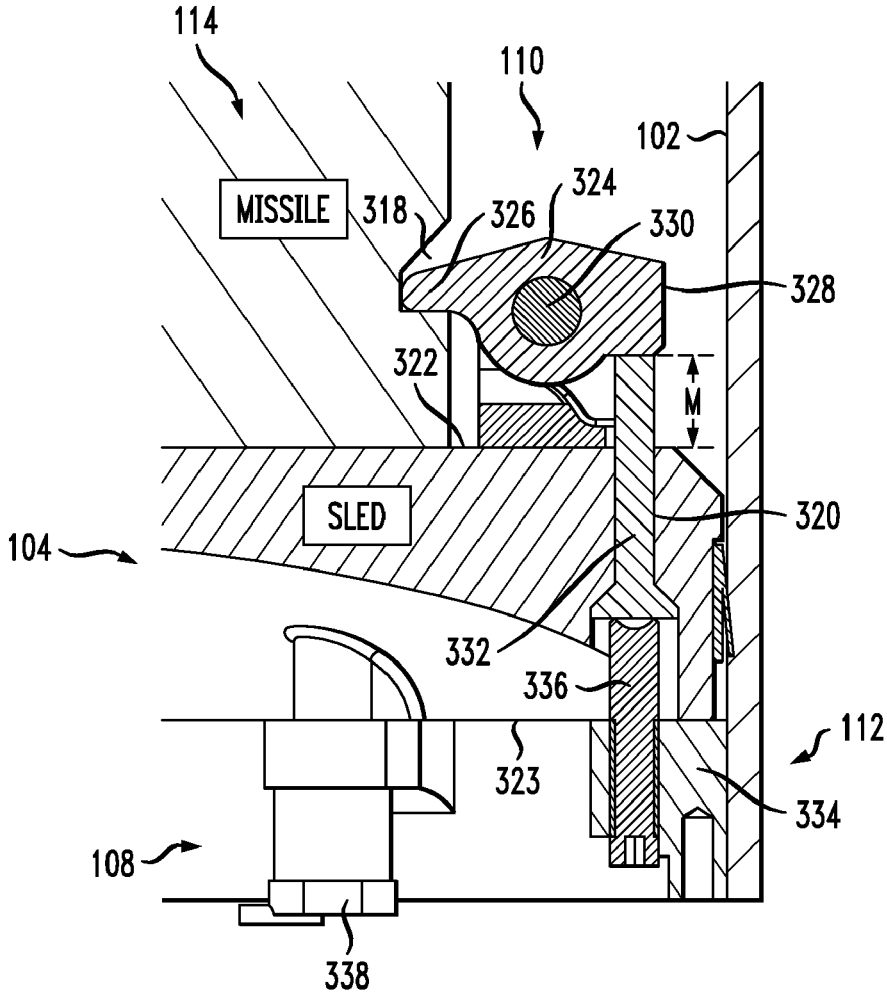
FIG. 3 depicts a partial cross-sectional view of an embodiment of the sled and munitions release mechanisms of the launch system of FIG. 1.
Figure 4:
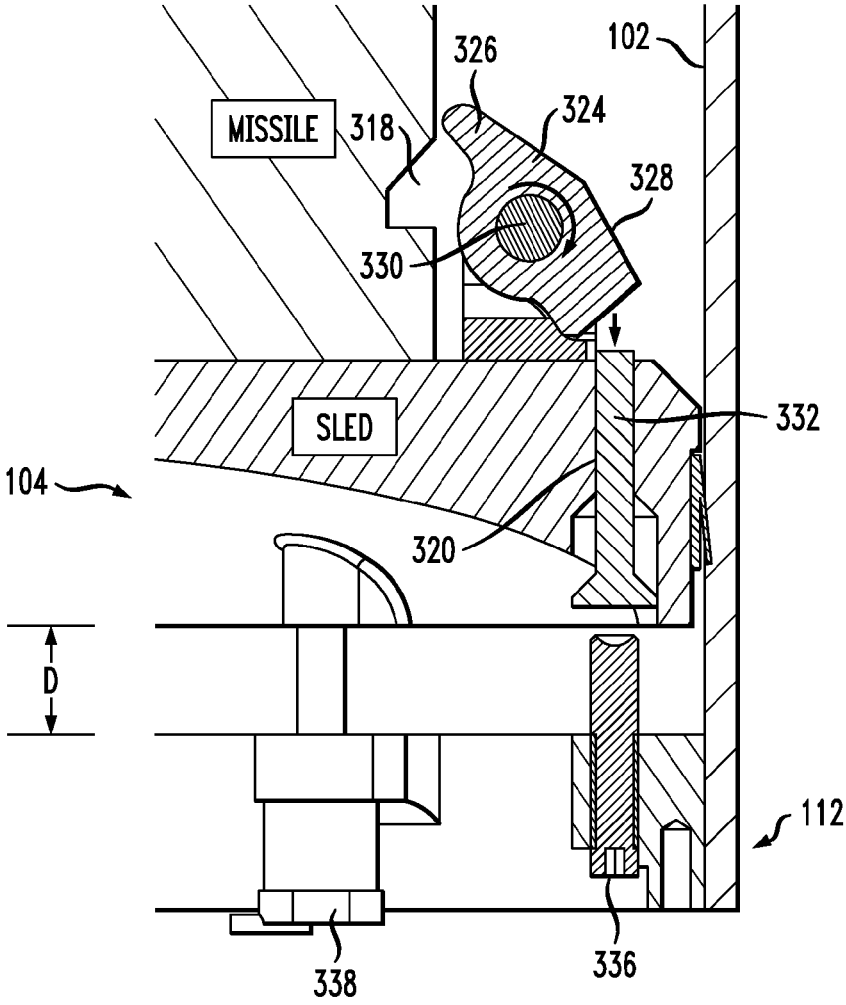
FIG. 4 depicts the mechanisms of FIG. 3 during launch, after the sled has moved distance D.

FIGS. 3 and 4 depict a partial view of launch system 100, and show, in greater detail, the illustrative embodiment of munitions release mechanism 110 as well as other structural details. The structural configuration of munitions release mechanism 110 that is depicted in these Figures, like all embodiments of munitions release mechanism 110 in accordance with the present invention, satisfies the requirement that the munitions release mechanism actuates passively as a function of the movement or position of sled 104.

FIG. 3 depicts launch system 100 in a pre-launch state, before sled 104 has been released. In the illustrative embodiment, sled release mechanism 108 is realized as a plurality of explosive bolts 338 (i.e., an active release mechanism). The explosive bolts releasably secure sled 104 to aft end 112 of canister 102. In a typical implementation, four bolts 338 are disposed about a marginal region of sled 104 at 90-degree intervals. For clarity, only one explosive bolt is depicted in FIG. 3.

In the illustrative embodiment, munitions release mechanism 110 is a group of cooperating elements comprising pivotable latch 324, movable trigger pin 332, and immovable support pin 336. In a typical implementation, four such groups of these cooperating elements are disposed at 90-degree intervals around munition 114. For clarity, only one group of these cooperating elements is depicted in FIG. 3.

Latch 324 is disposed on upper surface 322 of sled 104. Latch 324 includes nose portion 326, tail portion 328, and pin 330. Latch 324 is capable of pivoting or partially rotating about pin 330 from an anchoring position to a release position. In the pre-launch state depicted in FIG. 3, latch 324 is in the anchoring position, wherein nose portion 326 engages notch 318 in the casing of munition 114.

As described further below, since tail portion 328 of latch 324 is supported by trigger pin 332, which is, in turn, supported by support pin 336, latch 324 is prevented from pivoting out of the anchoring position when launch system 100 is in the pre-launch state.

Beginning now at aft end 112 of canister 102, support pin 336 is immovably coupled to flange 334. The flange is, in turn, coupled to canister 102. In the pre-launch state depicted in FIG. 3, support pin 336 extends into hole 320 within sled 104. The top of support pin 336 abuts the bottom of trigger pin 332, which is also partially disposed in hole 320.

In the pre-launch state that is depicted in FIG. 3, trigger pin 332 extends to a maximal distance M beyond upper surface 322 of sled 104 at which point it abuts tail portion 328 of latch 324. It will now be appreciated that in this pre-launch state, the support pin 336 and trigger pin 332 form a rigid column that prevents latch 324 from pivoting about pin 330 out of the anchoring position.

FIG. 4 depicts launch system 100 during launch, shortly after explosive bolts 338 have fired. Since the explosive bolts have fired, sled 104 is free to move upward toward the forward end of canister 102. It is assumed that the force generator (not depicted in FIG. 4, see, e.g., FIGS. 1 and 2) generates a force that causes sled 104 to accelerate upward through canister 102. In a relatively short period of time, sled 104 and munition 114 will reach the forward end of canister 102, at which point the munition is ejected by virtue of its own inertia. In FIG. 4, however, sled 104 is depicted after having moved a relatively short distance D.

As sled 104 moves forward in canister 102, trigger pin 332 loses the support of support pin 336, which is fixed to aft end 112 of canister 102. Since hole 320 is sized so that both support pin 336 and trigger pin 332 can freely slide within it, trigger pin 336 drops downward into the hole into the triggering position. In the illustrative embodiment, a stop (not depicted) prevents trigger pin 332 from falling completely through hole 320.

As trigger pin 332 drops into hole 320, it loses contact with tail portion 328 of latch 324. Latch 324 is configured to pivot about pin 330 to the release position when tail portion 328 is unsupported. In some embodiments, this is achieved by weighting tail portion 328. In some other embodiments, latch 324 is spring biased to pivot. In any case, having lost the support of trigger pin 332, latch 324 pivots around pin 330 to the release position. This releases munition 114 from sled 104.

It is appreciated that latch 324 will pivot from the anchoring position to the release position with only a slight change in position (e.g., an inch) of sled 104. This distance is a function of the relative sizing and shape of nose portion 326 of latch 324 and the shape of notch 318 of munition 114.

So, in the pre-launch state, support pin 336 and trigger pin 332 place and maintain latch 324 in the anchoring position. After sled 104 is released, such as by sled release mechanism 108 (e.g., explosive bolts 338, etc.), and has moved a small distance toward the forward end of canister 102, trigger pin 332 loses its support and moves to the triggering position. This enables (triggers) latch 324 to pivot out of contact with munition 114 to its release position.

In this fashion, munitions release mechanism 110 is actuated by movement/change in position of sled 104. So released, munition 114 is free to eject from canister 102 when suitably accelerated by sled 104.

It is to be understood that the above-described embodiments are merely illustrative of the present invention and that many variations of the above-described embodiments can be devised by those skilled in the art without departing from the scope of the invention. For example, in the illustrative embodiment, the sled release mechanism that releasably couples sled 104 to canister 102 is an active release mechanism. In some other embodiments, the sled release mechanism is a passive release mechanism, although it is configured different than munitions release mechanism 110.

The alternative embodiments listed above are a few of the many variations that will occur to those skilled in the art after reading this disclosure. It is therefore intended that such variations, and others that will occur to those skilled in the art in view of the present disclosure, be included within the scope of the following claims and their equivalents.

I claim:

1. An apparatus comprising:

a canister for receiving a munition;

a sled, wherein said sled is disposed within said canister, and wherein said sled is movable within said canister, and further wherein said munition is releasably coupled to said sled; and a munitions release mechanism, wherein said munitions release mechanism releases said munition from said sled, and wherein release of said munition is passively triggered, and wherein said munitions release mechanism comprises a pivotable latch, wherein said pivotable latch is coupled to said sled, and wherein said pivotable latch is movable between an anchoring position in which said pivotable latch secures said munition to said sled and a release position in which said pivotable latch does not secure said munition to said sled, and further wherein movement between said anchoring position and said release position is a function of a position of said sled within said canister.

2. The apparatus of claim 1, further comprising a sled release mechanism, wherein said sled release mechanism releases said sled for movement within said canister, wherein prior to release, said sled is immobilized proximal to an aft end of said canister.

3. The apparatus of claim 2 wherein said munition is released from said sled before said munition fires.

4. The apparatus of claim 1 wherein said munitions release mechanism is triggered when a pivoting member loses support from a vertically-movable member.

5. The apparatus of claim 1 wherein said munitions release mechanism is arranged so that as soon as said sled begins to move, said munitions release mechanism is triggered.

6. The apparatus of claim 1 wherein said munitions release mechanism further comprises a movable trigger pin, wherein said trigger pin is disposed within a hole that passes through said sled, and wherein said trigger pin moves within said hole between a supporting position and a triggering position as a function of the position of said sled within said canister.

7. The apparatus of claim 6 wherein before said sled moves toward said forward end of said canister, said sled is in a first position, and wherein in said first position, said movable trigger pin is in said supporting position in which said movable trigger pin supports said pivotable latch in said anchoring position.

8. The apparatus of claim 7 wherein after said sled has moved a minimum distance, said sled is in a second position, and wherein in said second position, said movable trigger pin is in said triggering position in which said movable trigger pin does not support said pivotable latch, so that said pivotable latch pivots to said release position.

9. The apparatus of claim 8 wherein said munitions release mechanism further comprises an immovable support pin, wherein said immovable support pin is fixed near an aft end of said canister, and further wherein when said sled is in said first position, said immovable support pin supports said trigger pin in said supporting position.

10. The apparatus of claim 9 wherein when said sled is in said second position, said immovable support pin does not support said trigger pin and, therefore, said trigger pin drops to said triggering position.

11. The apparatus of claim 1 further comprising said munition.

12. An apparatus comprising:

a canister, wherein said canister has an aft end and a forward end, and further wherein said canister receives a munition having a motor;

a sled, wherein said sled moves from said aft end to said forward end of said canister under applied force, wherein movement of said sled causes said munition to egress from said forward end of said canister, and further wherein said motor ignites after said munition egresses from said canister;

a release mechanism for releasably coupling said sled to said canister proximal to said aft end thereof; and a passive release mechanism for releasably coupling said munition to said sled, wherein said passive release mechanism is triggered to release said munition when said sled begins to move toward said forward end of said canister.

13. The apparatus of claim 12 wherein said passive release mechanism comprises a pivoting latch and a vertically movable trigger pin.

14. The apparatus of claim 12 wherein no element that is a part of said passive release mechanism is movable in a direction that is orthogonal to movement of said munition within said canister.

15. An apparatus comprising:

a canister for receiving a munition;

a sled, wherein said sled is disposed within said canister, and wherein said sled is movable within said canister, and further wherein said munition is releasably coupled to said sled; and a munitions release mechanism, wherein said munitions release mechanism releases said munition from said sled when a vertically-movable trigger pin falls out of a supporting position, thereby causing a latch to release.

16. The apparatus of claim 15 wherein an acceleration causes said trigger pin to fall out of said support position.

17. The apparatus of claim 15 wherein said munitions release mechanism is physically configured so that said trigger pin begins to fall as soon as said sled begins to move within said canister.

* * * * *